United States Patent [19]

Hughes et al.

[11] 4,337,618

[45] Jul. 6, 1982

[54] GAS TURBINE ENGINE FUEL BURNERS

[75] Inventors: Eric Hughes, Nuneaton; Donald McKnight, Binley, both of England

[73] Assignee: Rolls-Royce Limited, London, England

[21] Appl. No.: 152,655

[22] Filed: May 23, 1980

[30] Foreign Application Priority Data

Jun. 6, 1979 [GB] United Kingdom ..... 7919727

[51] Int. Cl.[3] ..... F02C 7/22; B05B 7/06

[52] U.S. Cl. ..... 60/39.55; 60/742; 239/424.5

[58] Field of Search ..... 60/742, 755, 39.55; 239/422, 423, 424, 424.5

[56] References Cited

U.S. PATENT DOCUMENTS 3,777,983 12/1973 Hibbins ..... 239/406
3,937,011 2/1976 Caruel et al. ..... 239/406
4,023,351 5/1977 Beyler et al. ..... 60/742
4,170,108 10/1979 Mobsby ..... 239/406
4,290,558 9/1981 Coburn et al. ..... 60/39.55

FOREIGN PATENT DOCUMENTS 257416 9/1926 United Kingdom ..... 239/406

*Primary Examiner*—Robert E. Garrett
*Attorney, Agent, or Firm*—Cushman, Darby & Cushman

[57] ABSTRACT

A gas turbine engine fuel injector which burns liquid and gaseous fuel and also has a water injection system to reduce the formation of nitrogen oxides ($NO_x$). The water can be discharged into a combustion chamber through an annular nozzle which is located between an inner annular fuel and air discharge nozzle and an outer gas discharge nozzle which comprises a circumferential row of discrete discharge nozzles. This allows the water to be injected at the most suitable point whichever fuel is being burnt. The water can also be injected into the inner annular fuel and air discharge nozzle.

7 Claims, 6 Drawing Figures

GAS TURBINE ENGINE FUEL BURNERS

This invention relates to fuel burners for gas turbine engines, more particularly to fuel burners which can operate on liquid fuel and gaseous fuel and which also are capable of injecting water to be mixed with the fuel streams to reduce the formation of nitrogen oxides ($NO_x$) when the fuel is burnt.

The present invention provides a gas turbine engine fuel injector having liquid fuel supply means, gaseous fuel supply means and water injection means, the liquid fuel supply means comprising a liquid fuel duct, a first manifold having a plurality of discrete outlets an annular discharge duct which is also arranged to receive a flow of compressed air and a liquid fuel and air discharge nozzle, the gaseous fuel supply means comprising a gaseous fuel duct, a second manifold having a plurality of discrete outlets forming a gaseous fuel discharge nozzle and the water injection means comprising a water supply duct and a third manifold having a plurality of outlets in communication with a water injection duct and a water and air discharge nozzle, the water and air discharge nozzle being located between the liquid fuel and gaseous fuel discharge nozzles.

The water may also be injected from the third manifold through further outlets into the annular fuel and air discharge duct.

Figure 1:
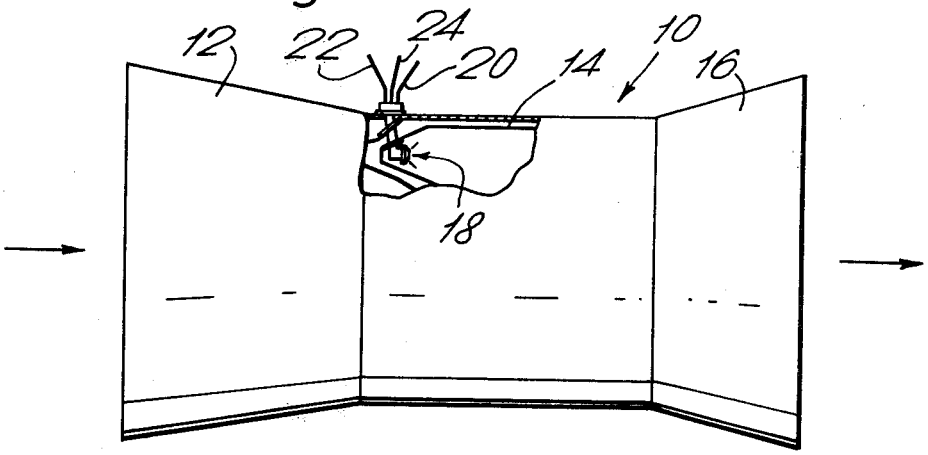
Figure 2:
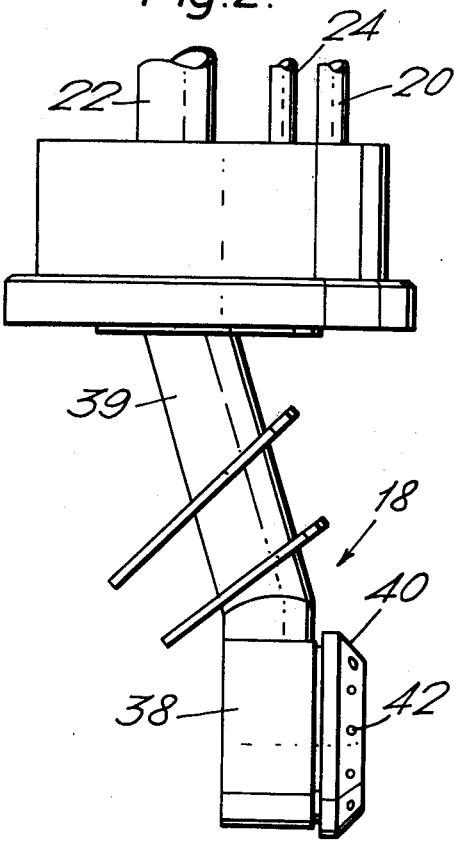
Figure 3:
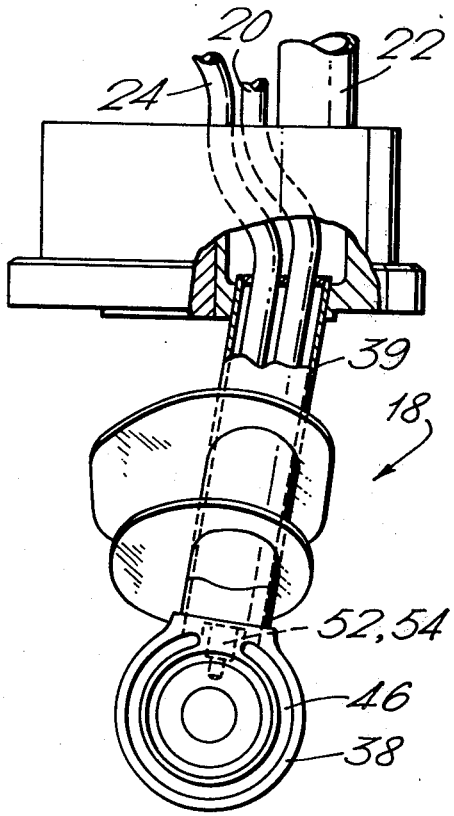
Figures 4, 5:
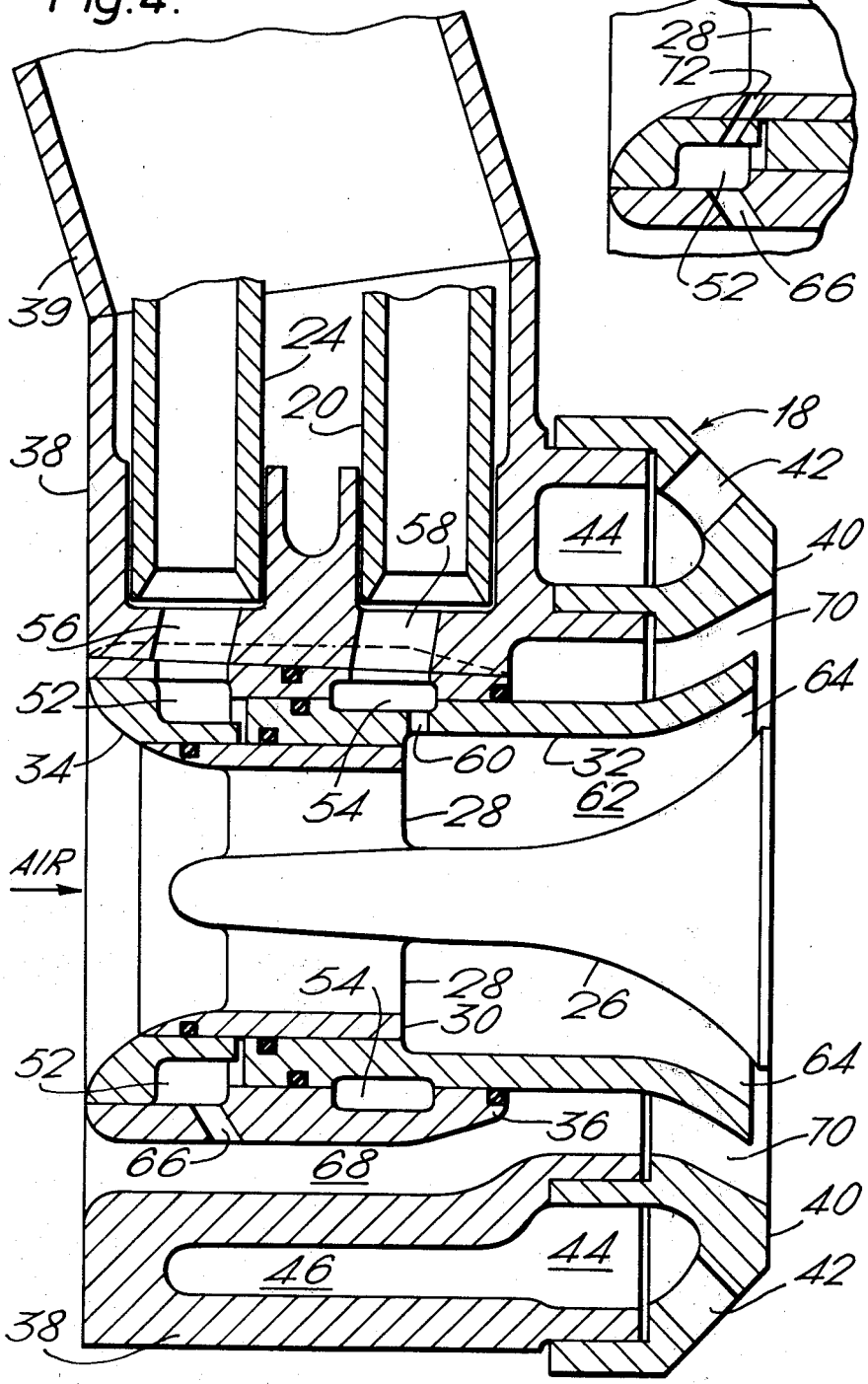
Figure 6:
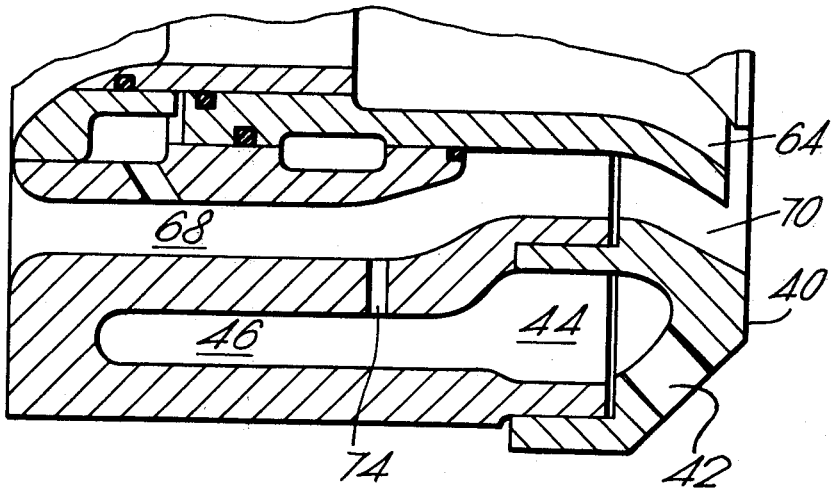

The present invention will now be more particularly described with reference to the accompanying Figures in which:

FIG. 1 is a diagrammatic view of a gas turbine engine incorporating one form of fuel injector according to the present invention, FIGS. 2 and 3 are side and front views respectively of the fuel injector of FIG. 1, FIG. 4 is a detailed sectional elevation of the fuel injector shown in the previous Figures, FIG. 5 is a detail of a modified form of fuel injector to that shown in FIG. 4 and, FIG. 6 is a detail of a further modification to the fuel injector shown in FIG. 4.

In FIG. 1, a gas turbine engine 10 has a compressor 12, a combustor 14 and a compressor driving turbine 16, the combustor having a number of fuel injectors 18 (only one which is shown) each having a liquid fuel supply line 20, a gaseous fuel supply line 22 and a water supply line 24, the lines 20, 22 24 being connected to respective sources of liquid fuel, gaseous fuel and water (not shown).

In FIGS. 2 to 4 a fuel injector 18 comprises a pintle 26 mounted on two arms 28 which are integral with a ring 30, the ring 30 being attached to sleeves 32 and 34 which themselves are attached to an outer sleeve 36. The outer sleeve 36 is attached to a banjo-shaped burner head 38 which is secured to a burner support arm 39. The arm 39 is hollow and contains the supply lines 20 and 24 and is in communication with the gaseous fuel supply line 22.

The burner has a gas ring 40 having a number of equi-spaced nozzles 42 for the discharge of gaseous fuel from a manifold 44 formed between a passage 46 in the burner head 38 and the gas ring 40.

The water and liquid fuel ducts 24 and 20 respectively are located internally of the arm 39 and communicate with respective water and liquid fuel manifolds 52 and 54 via respective ducts 56 and 58. The water manifold 52 is formed between the sleeves 34 and 36 and the liquid fuel manifold is formed between the sleeves 32 and 36.

The liquid fuel is discharged from the manifold 54 via outlets 60 into an annular passage 62 formed between the pintle 26 and the sleeve 32. Compressed air from the compressor 12 of the gas turbine engine 10 also flows into the passage 62 and the mixture of fuel and air leaves the passage 62 through an annular discharge nozzle 64.

It should be noted that in FIG. 3, the ring 40, the pintle 26 and sleeves 32, 34, 36 have been removed to show more clearly the internal details of the burner head 38.

The water is discharged from the manifold 52 via outlets 66 into an annular passage 68 formed between the sleeve 36 and the interior of the burner head 38 and leaves the passage through an annular discharge nozzle 70. The water injection system is provided to reduce the formation of nitrogen oxides ($NO_x$) and the nozzle 70 is located between the gaseous fuel outlets 42 and the fuel and air nozzle 64 so that in operation, the water discharged into the combustion chamber is as close as possible to each of these fuel outlets.

It will thus be seen that the fuel injector according to the invention essentially comprises an inner fuel injector, which in this case includes an annular nozzle 64 from which a liquid fuel and air mixture issues, and an outer fuel nozzle which in this example comprises a gaseous fuel ring 40 in the form of a number of discrete nozzles 42 and an intermediate duct 68 carrying air into which water is injected. The liquid fuel and air ducts 62 and discharge nozzle 64 and the duct 68 and nozzle 70 essentially comprise an air blast burner and it has been found that the air from the nozzle 70 tends to improve the fuel and air mixing when the injector is running on gaseous fuel as compared to a gas burner which just comprises the manifold 44 and nozzles 42, the air from the nozzle 70 also acting to atomise the liquid fuel from nozzle 64 when the burner is running on liquid fuel.

Referring to FIG. 5, water can also be injected into the duct 62 through outlets 72 and the water is directed so that it flows along the surface of the pintle 26 and meets the fuel and air at the nozzle 64.

Referring to FIG. 6, purge holes 74 which can be the same in number as the gas nozzles 42 are provided in the inner wall of the passage 46 to allow air from the duct 68 to purge the gas manifold 44 and to prevent liquid fuel and combustion products from entering the gas manifold. The duct 68 may be locally enlarged in the region of each hole 74 to increase the diffusion of the duct, thereby increasing the static pressure on the air duct side of each hole 74. This reduces the tendency of the gas fuel to flow into the air duct 68 and although some gas fuel may flow into the duct 68, the amount will not be sufficient to cause problems.

We claim:

1. A gas turbine engine fuel injector having a liquid fuel supply means, gaseous fuel supply means and water injection means, the liquid fuel supply means comprising a liquid fuel duct, a first manifold having a plurality of discrete outlets, an annular discharge duct which is also arranged to receive a flow of compressed air and a liquid fuel and air discharge nozzle, the gaseous fuel supply means comprising a gaseous fuel duct, a second manifold having a plurality of discrete outlets, forming a gaseous fuel discharge nozzle and the water injection means comprising a water supply duct and a third manifold having a plurality of outlets in communication with a water injection duct also arranged to receive a flow of compressed air, and a water and or air discharge nozzle, the water and the air discharge nozzle being located between the liquid fuel and gaseous fuel discharge nozzles.

2. A fuel injector as claimed in claim 1 in which the liquid fuel discharge nozzle comprises an inner annular discharge nozzle and the gaseous fuel nozzle comprises an outer ring of discrete nozzles, the water and air discharge nozzle being annular and located between the inner and outer nozzles.

3. A fuel injector as claimed in claim 1 or claim 2 in which the fuel injector includes a body having a partly annular gaseous fuel passage in communication with the gaseous fuel duct and a gas ring which in combination with flanges formed on the body forms the second manifold, the discrete outlets being formed in the gas ring.

4. A fuel injector as claimed in claim 3 in which the first manifold is formed between a first sleeve attached to the body and a second sleeve attached to the first sleeve and the annular liquid fuel and air discharge duct is formed between a pintle secured to the second sleeve and the second sleeve.

5. A fuel injector as claimed in claim 4 in which the third manifold is formed between the first sleeve and a third sleeve, the water injection duct being formed between the first sleeve and the body of the fuel injector.

6. A fuel injector as claimed in any one of claims 1, 2, 4 or 5 in which the third manifold has further outlets in communication with the annular fuel and air discharge duct.

7. A fuel injector as claimed in any one of claims 1, 2, 4 or 5 in which the gaseous fuel duct includes a plurality of purge holes arranged to receive a flow of compressed air.

* * * * *